US011466917B2

(12) United States Patent
Ishimizu

(10) Patent No.: US 11,466,917 B2
(45) Date of Patent: Oct. 11, 2022

(54) ICE MAKING DEVICE

(71) Applicant: NIDEC SANKYO CORPORATION, Nagano (JP)

(72) Inventor: Akio Ishimizu, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 145 days.

(21) Appl. No.: 17/118,546

(22) Filed: Dec. 10, 2020

(65) Prior Publication Data

US 2021/0180850 A1 Jun. 17, 2021

(30) Foreign Application Priority Data

Dec. 11, 2019 (JP) ..... JP2019-223497

(51) Int. Cl.

| | |
|---|---|
| ***F25C 1/04*** | (2018.01) |
| ***F25C 5/20*** | (2018.01) |
| ***F25C 1/246*** | (2018.01) |
| ***F25C 5/187*** | (2018.01) |

(52) U.S. Cl.

CPC ..... *F25C 5/22* (2018.01); *F25C 1/04* (2013.01); *F25C 1/246* (2013.01); *F25C 5/187* (2013.01); *F25C 2600/04* (2013.01); *F25C 2700/02* (2013.01)

(58) Field of Classification Search

CPC ..... F25C 1/04; F25C 1/246; F25C 2305/022; F25C 2600/04; F25C 2700/02; F25C 5/187; F25C 5/22

See application file for complete search history.

(56) References Cited

U.S. PATENT DOCUMENTS

| | | | | |
|---|---|---|---|---|
| 9,151,530 | B2 * | 10/2015 | Tanaka | F25C 5/187 |
| 9,784,491 | B2 * | 10/2017 | Choi | F25C 1/00 |
| 11,125,484 | B2 * | 9/2021 | Chatelle | F25C 1/243 |
| 2010/0207557 | A1 * | 8/2010 | Wilkinson | H02P 1/46 318/400.15 |
| 2015/0276295 | A1 * | 10/2015 | Barrena | F25C 1/00 62/135 |
| 2019/0063812 | A1 * | 2/2019 | Saito | F25C 5/06 |

FOREIGN PATENT DOCUMENTS

| | | |
|---|---|---|
| JP | 2010065974 | 3/2010 |

* cited by examiner

*Primary Examiner* — Filip Zec
(74) *Attorney, Agent, or Firm* — JCIPRNET

(57) ABSTRACT

In an ice making device, a frame supporting an ice tray and a drive unit has a first wall at a side of an ice detection member. Supported on the first wall is a regulation member rotatable between a first rotation position not to regulate coming down of the ice detection member and a second rotation position to regulate coming down of the ice detection member. By moving the regulation member to the second rotation position, later ice making is stopped even if ice accumulating below is not much. The regulation member includes a regulator in a circular arc form and is supported rotatably around a shaft. The regulation member as a rotary member is less liable to unexpectedly move from either of the first rotation position and the second rotation position, so that movement of the regulation member to a position not intended is suppressed.

7 Claims, 9 Drawing Sheets

ICE MAKING DEVICE

CROSS REFERENCE TO RELATED APPLICATIONS

This application claims the priority benefit of Japanese Patent Application No. 2019-223497, filed on Dec. 11, 2019. The entirety of the above-mentioned patent application is hereby incorporated by reference herein and made a part of this specification.

BACKGROUND

Field of the Invention

The present invention relates to an ice making device that makes ice by freezing water fed to an ice tray.

Description of the Related Documents

An ice making device to be installed in a refrigerator is described in Japanese Unexamined Patent Application Publication No. 2010-65974. An automatic ice making device of Japanese Unexamined Patent Application Publication No. 2010-65974 includes an ice tray, a drive unit that rotates the ice tray to cause ice to fall out of the ice tray, and an ice detection member (full ice detection lever) that is caused by the drive unit to come down from a standby position and detect the amount of ice accumulating below. If the ice detection member comes down to the lowest point position, an action of causing ice to fall out of the ice tray is performed on the assumption that the ice accumulating below is inadequate. If the ice detection member hits ice in the process of coming down and is no more able to come down, an action of discharging ice from the ice tray, an action of feeding water to the ice tray, and the like are stopped thereafter on the assumption that there exists a full ice state where ice has adequately accumulated below.

In the automatic ice making device of Japanese Unexamined Patent Application Publication No. 2010-65974, the ice tray is detachable from a frame along with a holder, so that it is possible to detach the ice tray for washing, for instance. A regulation member to regulate actions of the ice detection member is fitted on the frame. When the ice tray is detached from the frame along with the holder, a rib provided on the holder is disengaged from the regulation member, and the regulation member rotates to come down by the regulation member's own weight so as to perform positional regulation so that the ice detection member may not come down. Ice making is thus stopped while the ice tray is detached. When the holder is attached to the frame along with the ice tray, the regulation member is rotated upward by the rib on the holder and moves to a position where the regulation member does not regulate actions of the ice detection member. Consequently, ice making is performed.

Conventionally, a regulation member to regulate actions of an ice detection member is used for on-off switching of the ice making action. In Japanese Unexamined Patent Application Publication No. 2010-65974, for instance, the regulation member, which regulates actions of the ice detection member according to an attached/detached state of the ice tray, is provided. In addition, it has been proposed to manually achieve the on-off switching of the ice making action by changing the position of a regulation member through a manual operation by a user of an ice making device.

If a structure allowing the user to manually change the position of the regulation member is employed, the ice detection member or another object may hit and move the regulation member. The regulation member, which has moved to a position not intended, is not able to regulate actions of the ice detection member.

In view of the problems as above, an object of the present invention is to suppress a situation where a regulation member to regulate actions of an ice detection member moves to a position not intended and is, as a result, not able to regulate actions of the ice detection member.

SUMMARY

In order to solve the above problem, an ice making device according to at least an embodiment of the present invention includes an ice tray, a frame that supports the ice tray, an ice detection member configured to detect an amount of ice accumulating under the ice tray, a drive unit configured to drive the ice detection member downward from a first position and, when the ice detection member has come down below a second position, drive the ice tray to discharge ice, and a regulation member rotatably supported on the frame. A rotation range of the regulation member includes a first rotation position to permit the ice detection member to come down below the second position, and a second rotation position to hit the ice detection member between the first position and the second position and regulate coming down of the ice detection member.

In the ice making device, to which at least an embodiment of the present invention is applied, if the ice detection member comes down below the second position, the amount of ice accumulating under the ice tray is small, so that the ice tray is driven to discharge ice and an ice making action is performed. In contrast, if the ice detection member does not come down below the second position, there exists a full ice state where an adequate amount of ice has accumulated below, so that the discharge of ice is stopped and the ice making action is stopped as well. According to at least an embodiment of the present invention, the regulation member is supported on the frame, and the coming down of the ice detection member is regulated by changing the position of the regulation member. Therefore, the ice making action and the like can be stopped even in a state other than the full ice state. Furthermore, since the regulation member is a rotary member, the direction of movement of the regulation member differs depending on the rotation position. Consequently, the regulation member is less liable to come into contact with the ice detection member or the like and move thereby to a position not intended, which makes it possible to suppress a situation where the regulation member is not able to regulate actions of the ice detection member.

In at least an embodiment of the present invention, it is preferable that the ice detection member is driven by the drive unit from the first position to a specified position and moves by the ice detection member's own weight between the specified position and the second position, and the ice detection member hits the regulation member between the specified position and the second position. Such configuration makes it possible to avoid an overload state of the drive unit when the ice detection member hits the regulation member.

In at least an embodiment of the present invention, it is preferable that the ice detection member moves the regulation member from the second rotation position toward the first rotation position when the ice detection member hits the regulation member during moving from the second position to the first position. Such configuration makes it possible to cause the regulation member to retract by means of the ice detection member. Therefore, the ice detection member is capable of returning to a normal action if a user moves the regulation member according to an inappropriate timing.

In at least an embodiment of the present invention, it is preferable that the ice detection member moves the regulation member to a third rotation position between the second rotation position and the first rotation position when the ice detection member hits the regulation member during moving from the second position to the first position, and a center of gravity of the regulation member in the third rotation position is located on a side, where the second rotation position exists, with respect to a rotation center of the regulation member. Such configuration makes it possible to cause, with the ice detection member, the regulation member to retract into the third rotation position and then return by the regulation member's own weight to the first rotation position.

In at least an embodiment of the present invention, it is preferable that the regulation member includes a shaft rotatably supported on the frame and a regulator extending in a circular arc form around the shaft, and the ice detection member hits the regulator. By giving the regulator a circular arc form, the strength of the regulator is increased. In addition, the rotation of the regulation member is made smooth.

In at least an embodiment of the present invention, it is preferable that the frame includes a first locking part that holds the regulation member in the first rotation position and a second locking part that holds the regulation member in the second rotation position, the regulation member includes a locking counterpart that is secured to at least one of the first locking part and the second locking part, and the first locking part and the second locking part are elastically deformed or the locking counterpart is elastically deformed. Such configuration makes it possible to hold the regulation member in the first rotation position and the second rotation position. Therefore, the movement of the regulation member to a position not intended is suppressed. The regulation member can manually be rotated because either the locking parts or the locking counterpart is elastically deformed to release the lock. Moreover, a click feeling is obtained upon establishing the lock, so that the operation of switching the regulation member to the first rotation position and the second rotation position is easily and accurately carried out.

Preferably, the first locking part is a first holding groove provided on a first arm that is elastically deformed in a radial direction, the second locking part is a second holding groove provided on a second arm that is elastically deformed in the radial direction, and the locking counterpart is a projection that protrudes from the regulator in the radial direction. The regulation member is held in the first rotation position with the projection fitted in the first holding groove, and the regulation member is held in the second rotation position with the projection fitted in the second holding groove. Such configuration makes it possible to generate a click feeling when the projection is fitted into the holding grooves.

According to at least an embodiment of the present invention, if the ice detection member comes down below the second position, the amount of ice accumulating under the ice tray is small, so that the ice tray is driven to discharge ice and the ice making action is performed. In contrast, if the ice detection member does not come down below the second position, there exists the full ice state where an adequate amount of ice has accumulated below, so that the discharge of ice is stopped and the ice making action is stopped as well. According to at least an embodiment of the present invention, the regulation member is supported on the frame, and the coming down of the ice detection member is regulated by changing the position of the regulation member. Therefore, the ice making action and the like can be stopped even in a state other than the full ice state. Since the regulation member is a rotary member, the direction of movement of the regulation member differs depending on the rotation position. Consequently, the regulation member is less liable to come into contact with the ice detection member or the like and move thereby to a position not intended, which makes it possible to suppress a situation where the regulation member is not able to regulate actions of the ice detection member.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

The following description is made on an ice making device 1 according to at least an embodiment of the present invention with reference to the accompanying drawings. In the description below, three directions orthogonal to one another are assumed to be the x-axial direction, the y-axial direction, and the z-axial direction, respectively. The x-axial direction is a direction along the direction of a rotational axis L of an ice tray 2. The z-axial direction is the vertical direction in an installation position (position illustrated in FIG. 1) of the ice making device 1. With respect to the x-axial direction, the direction toward the side, where the ice tray 2 is located, is designated as a direction X1 and the direction toward the side, where a drive unit 3 is located, is designated as a direction X2. With respect to the z-axial direction, the upward direction is designated as a direction Z1 and the downward direction is designated as a direction Z2. With respect to the y-axial direction, the direction toward the side, where an ice detection member 4 is located, is designated as a direction Y1 and the direction opposite with the direction Y1 is designated as a direction Y2.

General Configuration

Figure 1:
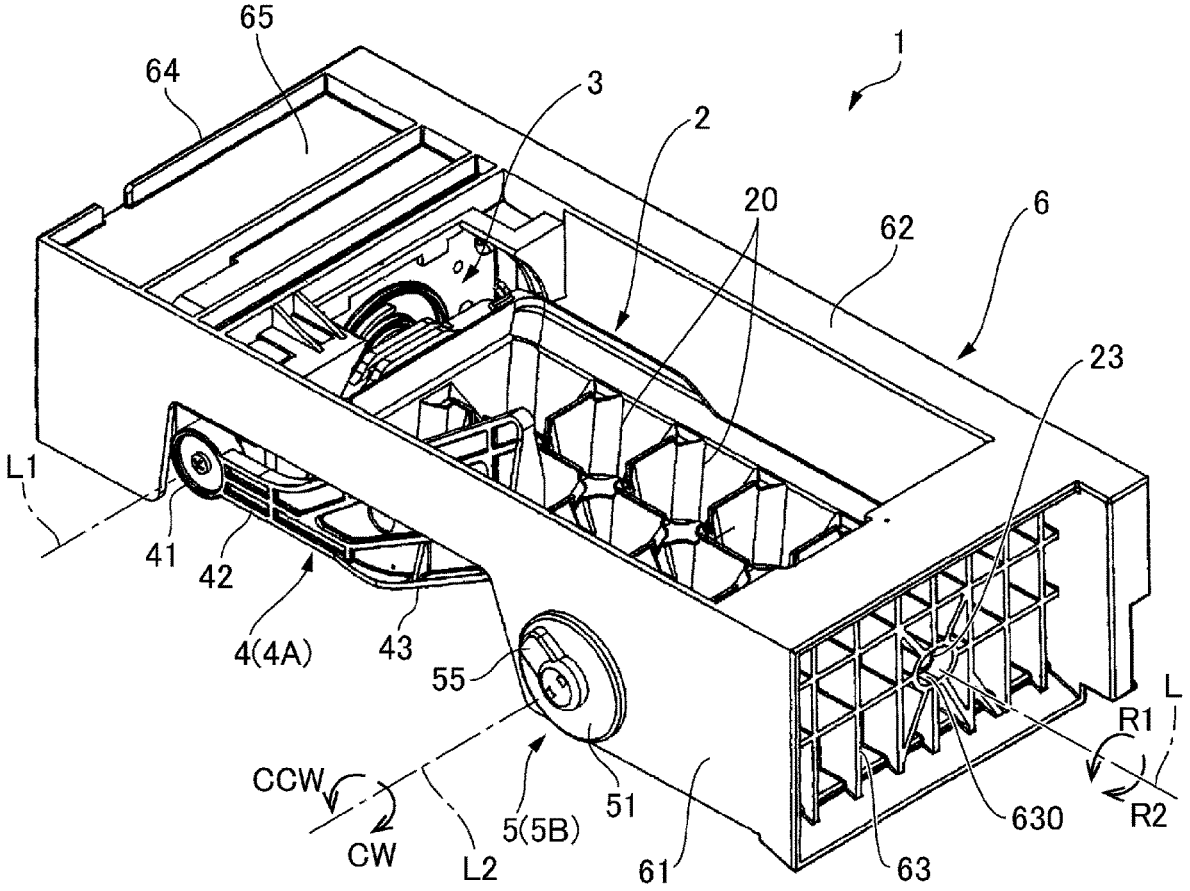
FIG. 1 is a perspective view of an ice making device, to which at least an embodiment of the present invention is applied.
Figure 1:
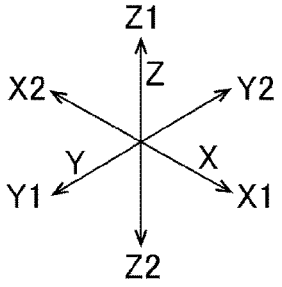
Figure 2:
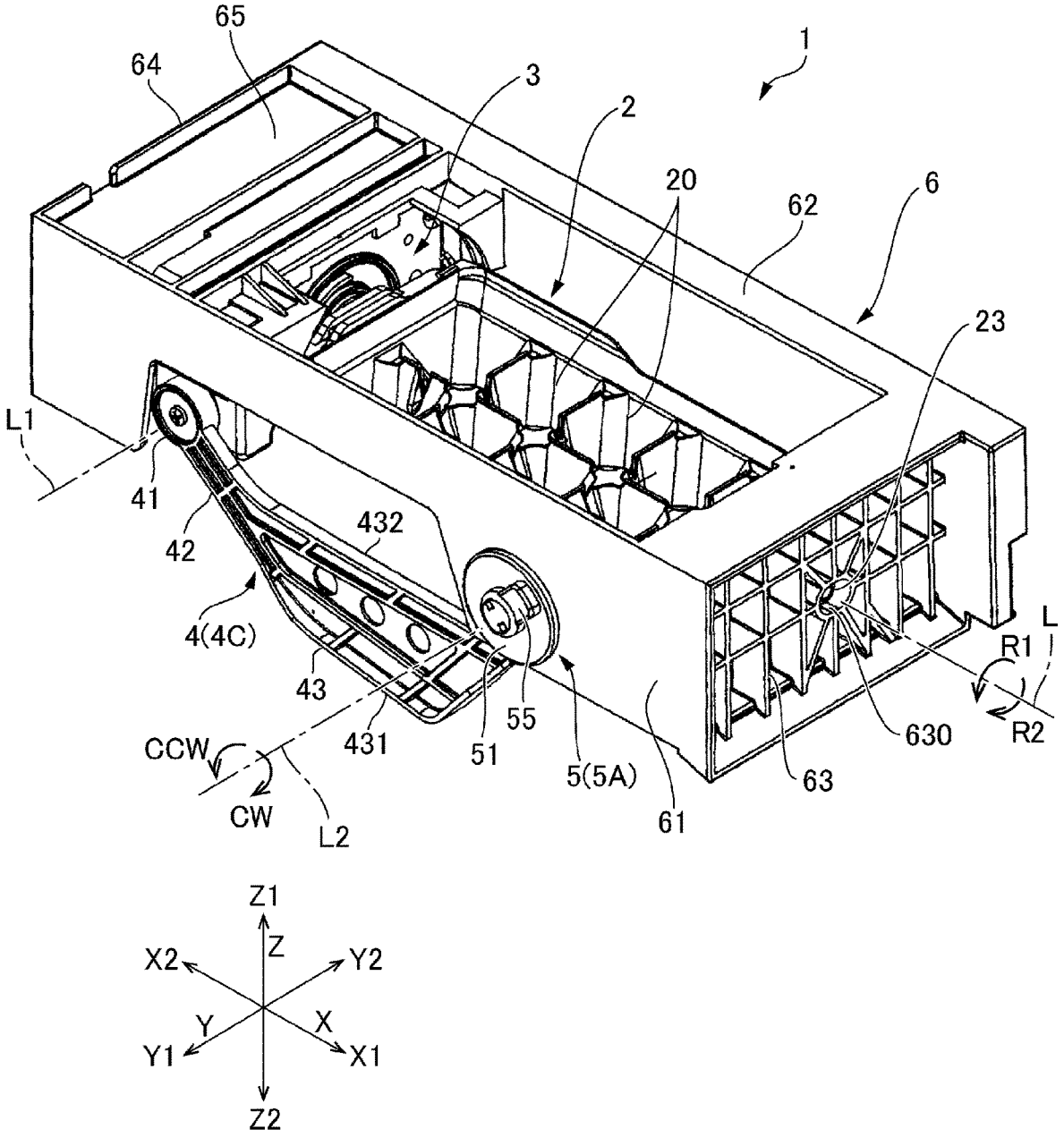
FIG. 2 is a perspective view illustrating a state where an ice detection member in the ice making device of FIG. 1 has been moved to a lowest point position.
Figure 3:
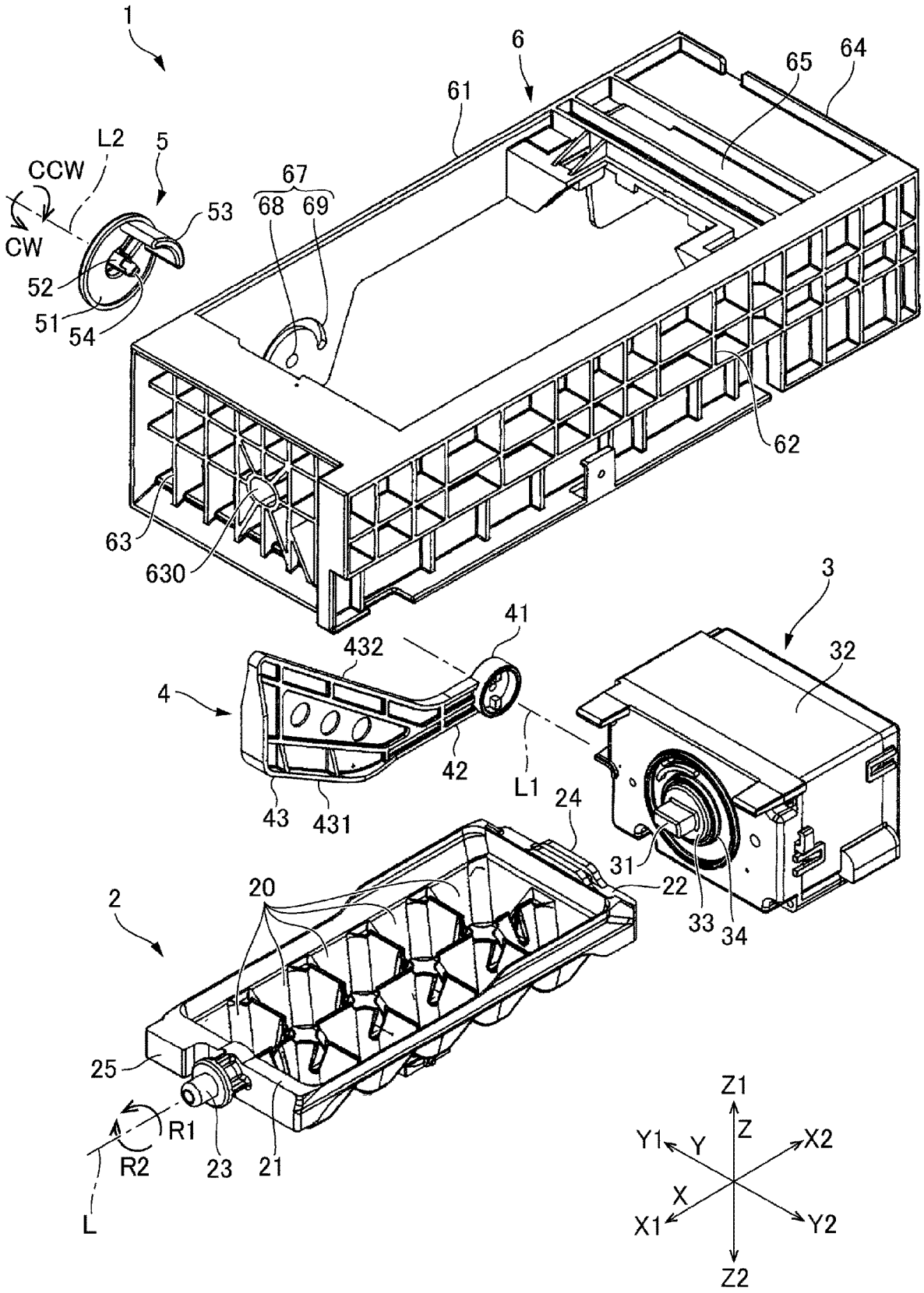
FIG. 3 is an exploded perspective view of the ice making device of FIG. 1.

FIG. 1 is a perspective view of the ice making device 1, to which at least an embodiment of the present invention is applied. FIG. 2 is a perspective view illustrating a state where the ice detection member 4 in the ice making device 1 of FIG. 1 has been moved to a lowest point position 4C. FIG. 3 is an exploded perspective view of the ice making device 1 of FIG. 1. The ice making device 1 is to be installed in a refrigerator. The ice making device 1 includes the ice tray 2, whose top face is fed with water from a water feeding mechanism (not illustrated), a frame 6 that supports the ice tray 2, the drive unit 3 supported on the frame 6, the ice detection member 4 for detecting the amount of ice accumulating in an ice storing container (not illustrated) provided under the ice tray 2, and a regulation member 5 supported on the frame 6. The drive unit 3 is fed with power from a refrigerator main body and controlled by an ice making controller (not illustrated) provided on the refrigerator main body.

As described later, the drive unit 3 drives the ice detection member 4 from a standby position 4A (see FIGS. 1 and 4) toward a lower, ice detection position 4B (see FIG. 5) according to a specified timing to carry out an ice detection action to detect the amount of ice accumulating in the ice storing container. The ice making controller discharges ice from the ice tray 2 if the amount of ice accumulating in the ice storing container is small. On the other hand, the ice making controller stops the discharge of ice from the ice tray 2 and the feeding of water to the ice tray 2 if there exists a full ice state where an adequate amount of ice has accumulated in the ice storing container. In the present embodiment, the drive unit 3 twists the ice tray 2 when reversing the ice tray 2 around the rotational axis L, so as to discharge ice from the ice tray 2.

Ice Tray

The ice tray 2 is made of a material that is elastically deformable, a resin material in the present embodiment. As illustrated in FIG. 3, the ice tray 2 has a first wall 21 at the end in the direction X1 and a second wall 22 at the end in the direction X2. The first wall 21 includes a shaft 23 that protrudes in the direction X1 and a protrusion 25 that protrudes in the direction X1 at the end in the direction Y1. The second wall 22 is provided with a coupling section 24 to be coupled with an output shaft 31 of the drive unit 3.

The ice tray 2 includes a plurality of water storing recesses 20. Between the first wall 21 and the second wall 22, five rows of water storing recesses 20, in each of which rows two water storing recesses 20 stand side by side in the Y-axial direction, are formed in the X-axial direction. On the bottom face of the ice tray 2, a thermistor (not illustrated) to detect the temperature of the ice tray 2 is arranged. The detection of the temperature of the ice tray 2 by the thermistor allows the ice making controller to determine whether or not the water fed to the water storing recesses 20 of the ice tray 2 has frozen.

Drive Unit

The drive unit 3 includes a rectangular parallelepiped-shaped case 32 linked to the frame 6. In the inside of the case 32, a motor (not illustrated) serving as a driving source, a rotational transmission mechanism (not illustrated) to transmit the driving force of the motor, and a cam gear 33, to which the turning effort of the motor is transmitted by the rotational transmission mechanism, are arranged. The output shaft 31 is integrally formed with the cam gear 33. The output shaft 31 protrudes out of the case 32 through a hole 34 provided in the side wall in the direction X1 of the case 32 and is fitted in the coupling section 24 of the ice tray 2.

During the discharge of ice from the ice tray 2, the drive unit 3 rotates the output shaft 31 in a direction R1. As a result, the ice tray 2 is changed in position from an upward ice making position to an obliquely downward, ice separating position. The ice tray 2 is returned to the ice making position by rotating the output shaft 31 in a direction R2.

Frame

The frame 6 has a first wall 61 extending in the x-axial direction on a side in the direction Y1 of the ice tray 2, a second wall 62 extending in the x-axial direction on a side in the direction Y2 of the ice tray 2, a third wall 63 extending in the y-axial direction to join end portions in the direction X1 of the first wall 61 and the second wall 62 together, and a fourth wall 64 extending in the y-axial direction to join end portions in the direction X2 of the first wall 61 and the second wall 62 together. In addition, the frame 6 includes a rectangular support 65 that extends from the upper end of the fourth wall 64 in the direction X1 and partially joins the first wall 61 and the second wall 62 together above the drive unit 3.

The third wall 63 is a porous wall including a plurality of plate-like ribs linked with one another. In the middle of the third wall 63, a shaft hole 630 that rotatably supports the shaft 23 of the ice tray 2 is provided. The shaft 23 of the ice tray 2 is thus supported on the frame 6 while the second wall 22 of the ice tray 2 is supported on the frame 6 through the coupling section 24 and the drive unit 3. Provided inside the third wall 63 is a contact part (not illustrated) that comes into contact with the protrusion 25 of the ice tray 2 when the ice tray 2 is rotated about the rotational axis L in the direction R1.

Ice Detection Member

The ice detection member 4 includes a shaft 41 coupled to the side face in the direction Y1 of the drive unit 3, a first arm 42 extending from the shaft 41 in the direction X1, and a second arm 43 extending from the end in the direction X1 of the first arm 42 in a direction inclined to the first arm 42. The drive unit 3 causes the ice detection member 4 to rotate about a rotational axis L1 to move between the standby position 4A illustrated in FIG. 1 and the lowest point position 4C illustrated in FIG. 2. In the standby position 4A illustrated in FIG. 1, the second arm 43 extends obliquely upward. In the lowest point position 4C illustrated in FIG. 2, an edge 431 in the direction Z2 of the second arm 43 extends obliquely downward, while an edge 432 in the direction Z1 of the second arm 43 extends almost horizontally. When performing the ice detection action, the ice detection member 4 is located in the ice detection position 4B (see FIG. 5) between the standby position 4A and the lowest point position 4C, and, in the ice detection position 4B, the edge 431 in the direction Z2 of the second arm 43 extends almost horizontally and the contact area with ice is increased.

Ice Detection Action and Ice Discharging Action

In the ice making device 1, the ice detection action and the ice discharging action, both described below, are performed if it is determined, based on the result of the detection of the temperature of the ice tray 2 by the thermistor (not illustrated), that the ice making in the ice tray 2 is complete. In the ice detection action, the drive unit 3 rotates the ice detection member 4 about a rotational axis L2, that is to say, drives the ice detection member 4 from the standby position 4A as a first position toward the lowest point position 4C. If the ice detection member 4 comes down to the lowest point position 4C, a switch provided on the drive unit 3 is turned on, so that ice is discharged from the ice tray 2 on the assumption that the amount of ice accumulating in the ice storing container is small.

During the discharge of ice from the ice tray 2, the drive unit 3 rotates the output shaft 31 in the direction R1, when the ice tray 2 rotates in the direction R2 and an end portion on the output shaft 31 side is reversed. In the course of such reversion, the protrusion 25 of the ice tray 2 comes into contact with the contact part (not illustrated) of the frame 6 and the ice tray 2 is twisted. As a result, ice is discharged from the ice tray 2. After the discharge of ice, the drive unit 3 rotates the output shaft 31 in the direction R2 to return the ice tray 2 to the upward, ice making position. Then, water is fed to the ice tray 2 and the ice making action is continued.

On the other hand, the switch on the drive unit 3 is not turned on even after a lapse of specified time in the ice detection action if the ice detection member 4 does not come down to the lowest point position 4C but stops in the ice detection position 4B as a second position, which is set above the lowest point position 4C. In that case, the ice making action is stopped on the assumption that there exists the full ice state where an adequate amount of ice has accumulated in the ice storing container. In other words, the drive unit 3 does not drive the ice tray 2 to discharge ice, and returns the ice detection member 4 to the standby position 4A (the first position).

Regulation Member

Figure 4:
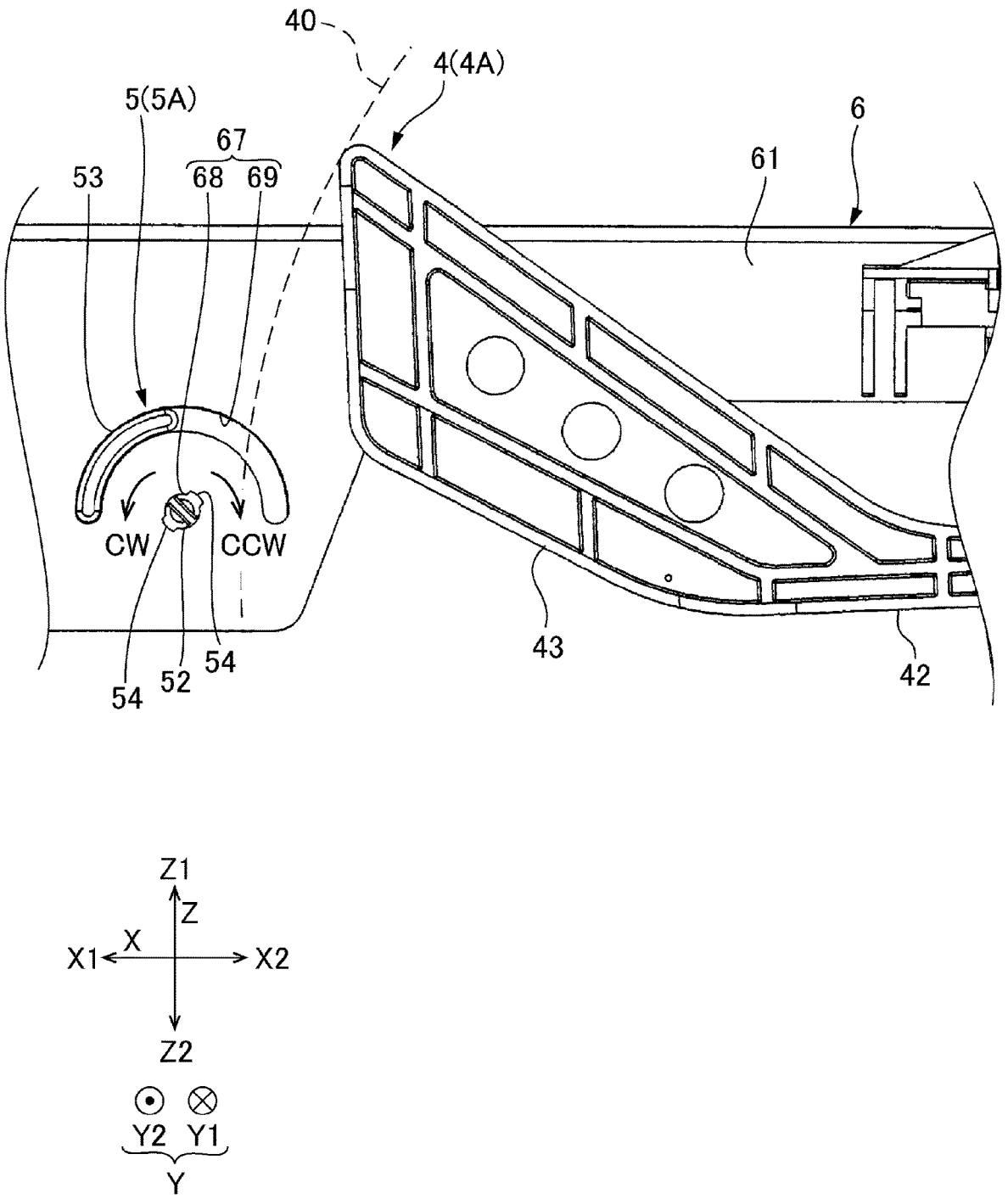
FIG. 4 is a side view illustrating a state where a regulation member has moved to a first rotation position where the regulation member permits coming down of the ice detection member.
Figure 5:
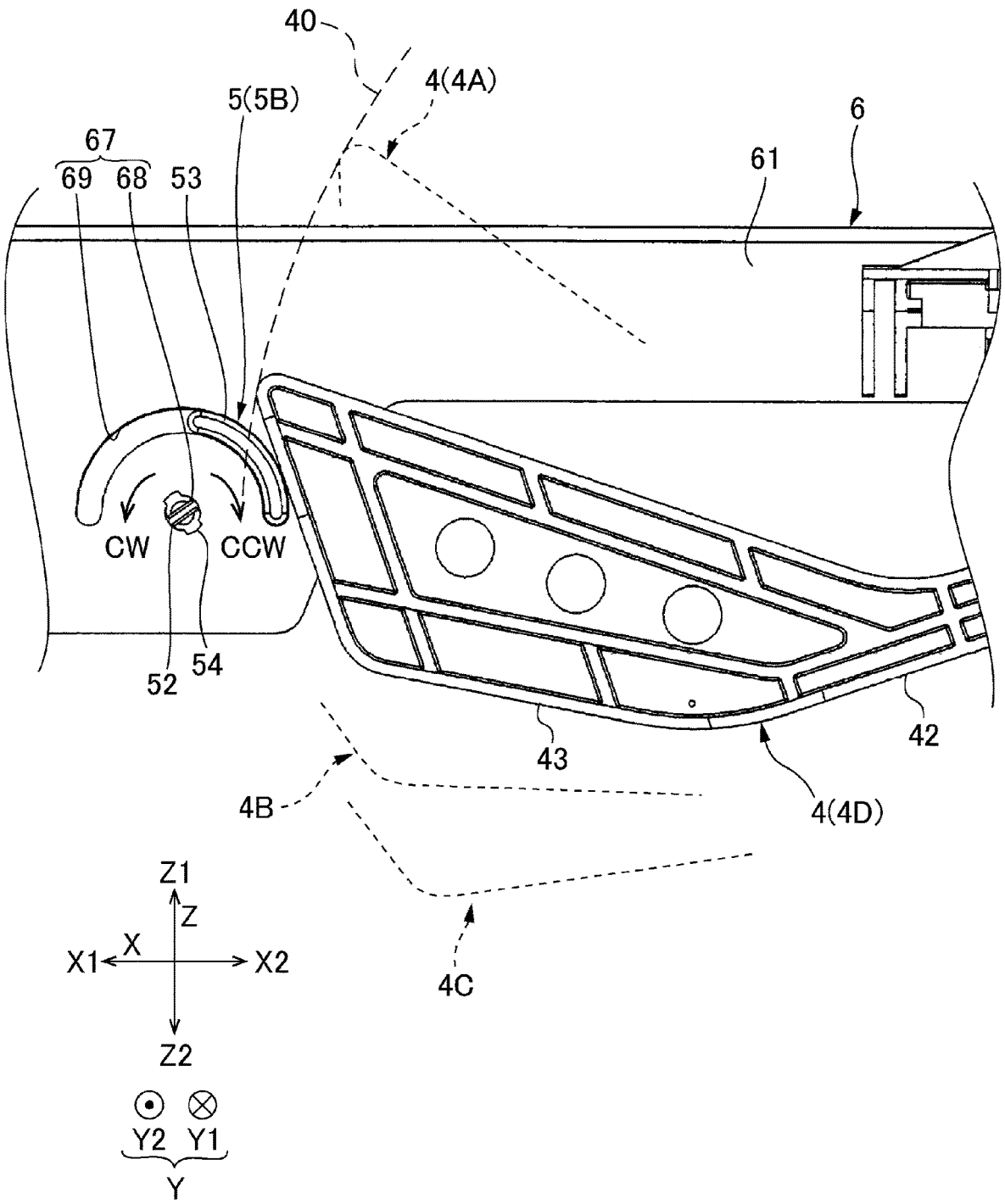
FIG. 5 is a side view illustrating a state where the regulation member has moved to a second rotation position where the regulation member regulates the coming down of the ice detection member.

FIG. 4 is a side view illustrating a state where the regulation member 5 has moved to a first rotation position 5A where the regulation member 5 permits coming down of the ice detection member 4. FIG. 5 is a side view illustrating a state where the regulation member 5 has moved to a second rotation position 5B where the regulation member 5 regulates the coming down of the ice detection member 4. In the state illustrated in FIG. 5, the ice detection member 4 has hit the regulation member 5 from above. The regulation member 5 is supported on the frame 6 rotatably about the rotational axis L2, which is essentially parallel to the rotational axis L1 of the ice detection member 4.

The regulation member 5 is rotatable within a range including the first rotation position 5A and the second rotation position 5B. As illustrated in FIG. 4, the first rotation position 5A is a position where the regulation member 5 permits the coming down of the ice detection member 4 below the ice detection position 4B. As illustrated in FIG. 5, the second rotation position 5B is a position where the regulation member 5 inhibits the coming down of the ice detection member 4 to the ice detection position 4B. When the ice detection member 4 comes down to an interference position 4D set between the standby position 4A and the ice detection position 4B, as illustrated in FIG. 5, the second arm 43 of the ice detection member 4 comes into contact with the regulation member 5, which has moved to the second rotation position 5B, so that the ice detection member 4 is inhibited from coming down to the ice detection position 4B.

During the ice detection action, the drive unit 3 drives the ice detection member 4 from the standby position 4A (the first position) to a specified position and causes the ice detection member 4 to move by the ice detection member 4's own weight between the specified position and the lowest point position 4C. In the present embodiment, the ice detection member 4 is moved by the drive unit 3 up to a drive termination position (the specified position) set between the standby position 4A and the interference position 4D and moves by the ice detection member 4's own weight between the drive termination position and the lowest point position 4C. Accordingly, the ice detection member 4 is moving by the ice detection member 4's own weight when coming into contact with the regulation member 5 in the interference position 4D.

As illustrated in FIGS. 1 and 2, the regulation member 5 is fitted on the first wall 61, which is located at the side of the ice detection member 4 in the frame 6. As illustrated in FIG. 3, the regulation member 5 includes a disk 51, a shaft 52 protruding from the center of the disk 51 in the direction Y2, and a regulator 53 protruding from a peripheral portion of the disk 51 in the direction Y2. The regulator 53 is a circular arc wall that extends in a circular arc form around the shaft 52. In the first wall 61 of the frame 6, a regulation member fitting section 67 is formed. The regulation member fitting section 67 includes a shaft hole 68 passing through the first wall 61, and a guide groove 69 that passes through the first wall 61 and extends in a circular arc form around the shaft hole 68. The shaft 52 of the regulation member 5 is inserted in the shaft hole 68, and a locking part 54 provided at the tip of the shaft 52 is secured to an edge of the shaft hole 68. The regulation member 5 is thus prevented from being disengaged from the frame 6. The regulator 53 is arranged in the guide groove 69 and protrudes from the guide groove 69 toward the side (in the direction Y2), where the ice detection member 4 is located.

As illustrated in FIGS. 1 and 2, the disk 51 is arranged on the side face in the direction Y1 of the frame 6. A handle 55 protruding in the direction Y1 is formed on the disk 51. The handle 55 is arranged almost in the center of the angular range of formation of the regulator 53. A user can manipulate the handle 55 from the outside of the frame 6 with the user's fingers to rotate the regulation member 5 about the rotational axis L2. When the regulation member 5 rotates around the shaft 52, the regulator 53 moves in the guide groove 69 in the circumferential direction. As illustrated in FIG. 4, in the first rotation position 5A, the regulator 53 is located in an end portion on one side CW in the circumferential direction of the guide groove 69. As illustrated in FIG. 5, in the second rotation position 5B, the regulator 53 is located in an end portion on the other side CCW in the circumferential direction of the guide groove 69.

As described above, in the present embodiment, a user can manually change the rotation position of the regulation member 5 between the first rotation position 5A and the second rotation position 5B. As illustrated in FIG. 4, in the first rotation position 5A, the regulator 53 is located on an outer peripheral side of a rotation range 40 of the ice detection member 4, with the rotation range 40 being indicated with a broken line. Consequently, the interference with the ice detection member 4 by the regulator 53 is avoided and the coming down of the ice detection member 4 below the ice detection position 4B is permitted when the regulation member 5 is located in the first rotation position 5A.

As illustrated in FIG. 5, in the second rotation position 5B, part of the regulator 53 is located on an inner peripheral side of the rotation range 40 of the ice detection member 4. Consequently, if the regulation member 5 is moved to the second rotation position 5B, the second arm 43 of the ice detection member 4 comes into contact with the regulator 53 from above when the ice detection member 4 comes down to the interference position 4D between the standby position 4A and the ice detection position 4B. In the second rotation position 5B, the regulator 53 is located in the end portion on the side CCW in the circumferential direction of the guide groove 69 and, accordingly, the regulation member 5 does not rotate even if hit by the ice detection member 4. Therefore, the ice detection member 4 is inhibited by the regulation member 5 from coming down to the ice detection position 4B.

Retracting Action of Regulation Member Caused by Ice Detection Member

Figure 6:
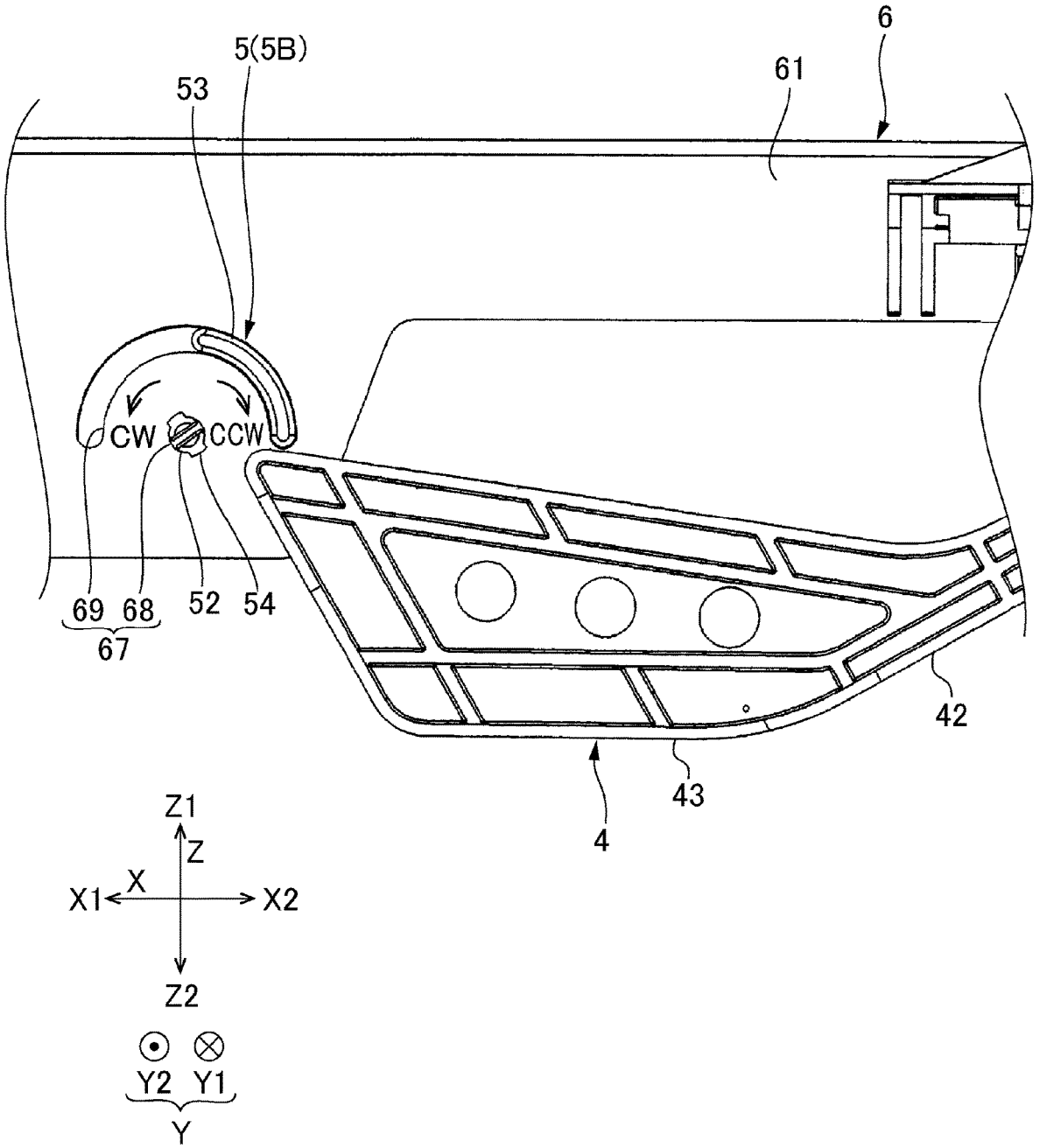
FIG. 6 is a side view explaining a retracting action of the regulation member caused by the ice detection member and illustrating a state where the ice detection member has hit the regulation member in the second rotation position from below.
Figure 7:
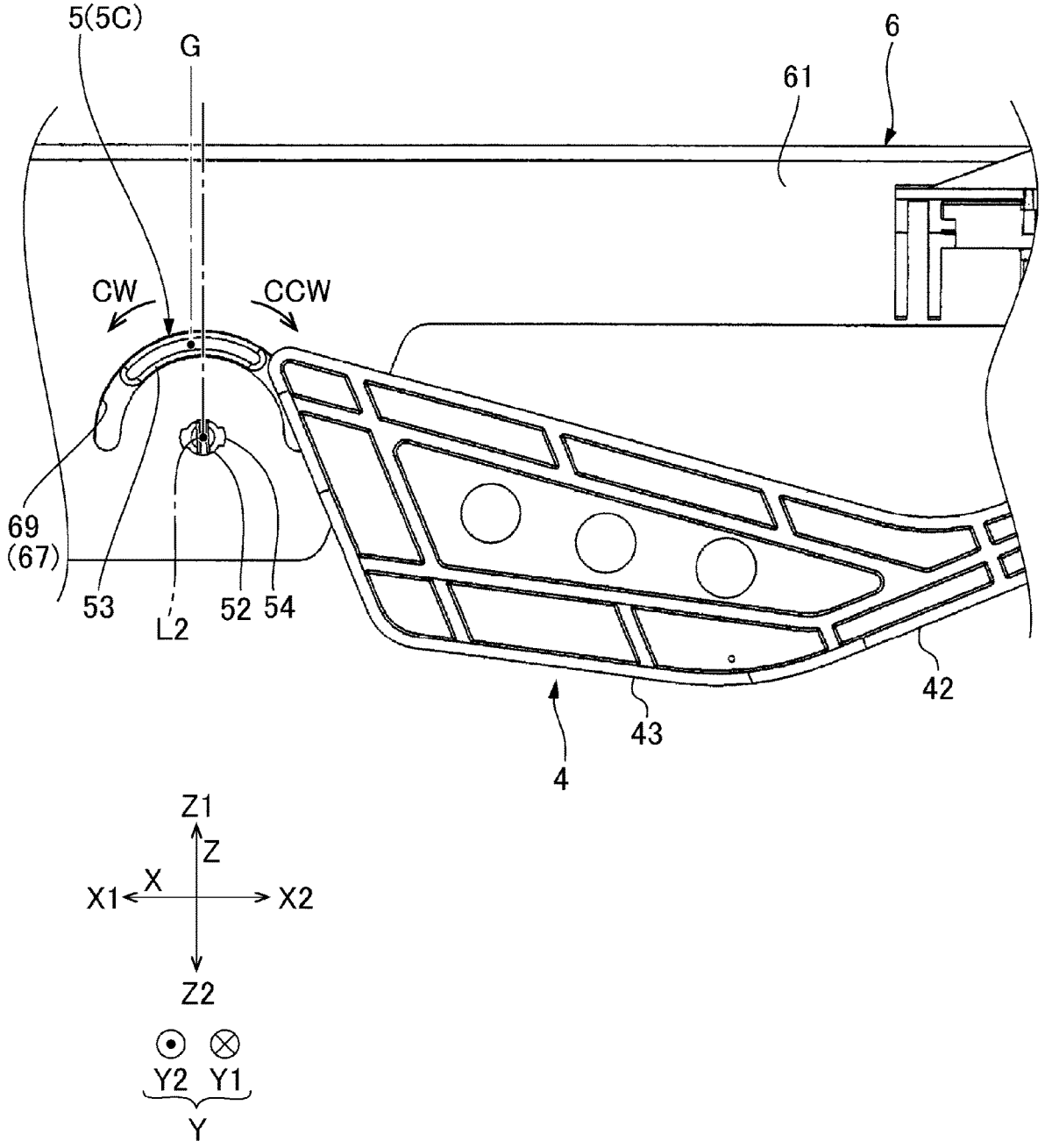
FIG. 7 is a diagram explaining a retracting action of the regulation member caused by the ice detection member and illustrating a state where the regulation member has moved to a third rotation position.

FIGS. 6 and 7 are diagrams explaining a retracting action of the regulation member 5 caused by the ice detection member 4. FIG. 6 is a side view illustrating a state where the ice detection member 4 has hit the regulation member 5 in the second rotation position 5B from below. FIG. 7 is a diagram illustrating a state where the regulation member 5 has moved to a third rotation position 5C. Since a user can manually rotate the regulation member 5 in the ice making device 1, the regulation member 5 may be manipulated in the process of the ice detection action. In other words, the regulation member 5 may be moved to the second rotation position 5B by a user's manipulation when the ice detection member 4 has come down below the regulation member 5. In the present embodiment, even if such situation has occurred, the ice detection member 4 causes the regulation member 5 to retract into the first rotation position 5A and return to a normal action.

If a user manipulates the regulation member 5 to change the position of the regulation member 5 to the second rotation position 5B when the ice detection member 4 has come down below the regulation member 5, the ice detection member 4 collides against an end portion on the side CCW in the circumferential direction of the regulator 53 from below on the way from the ice detection position 4B (the second position) to the standby position 4A (the first position), as illustrated in FIG. 6. If the ice detection member 4 moves further upward from the position in FIG. 6, the regulator 53 is pushed up by the ice detection member 4 to rotate toward the side CW in the circumferential direction.

The regulation member 5 is rotated by the ice detection member 4 to the third rotation position 5C in FIG. 7. As illustrated in FIG. 7, in the third rotation position 5C, the center of gravity G of the regulation member 5 is located on the first rotation position 5A side (i.e., the side CW) with respect to the rotation center of the regulation member 5. Since the regulation member 5 rotates about the rotational axis L2, the center of gravity G of the regulation member 5 is located on the first rotation position 5A side (i.e., the side CW) with respect to the rotational axis L2. Therefore, the regulation member 5, which has been rotated by the ice detection member 4 to the third rotation position 5C, rotates thereafter by the regulation member 5's own weight from the third rotation position 5C to the first rotation position 5A. The regulation member 5 is thus caused to retract into the first rotation position 5A.

Chief Effects of Present Embodiment

As described above, the ice making device 1 according to the present embodiment includes the ice tray 2, the frame 6 supporting the ice tray 2, the ice detection member 4 to detect the amount of ice accumulating under the ice tray 2, the drive unit 3, which drives the ice detection member 4 from the standby position 4A (the first position) downward, and drives the ice tray 2 to discharge ice if the ice detection member 4 comes down below the ice detection position 4B (the second position), and the regulation member 5 rotatably supported on the frame 6. The rotation range of the regulation member 5 includes the first rotation position 5A, where the regulation member 5 permits the coming down of the ice detection member 4 below the ice detection position 4B (the second position), and the second rotation position 5B, where the regulation member 5 hits the ice detection member 4 between the standby position 4A (the first position) and the ice detection position 4B (the second position) to regulate the coming down of the ice detection member 4.

In the ice making device 1 according to the present embodiment, if the ice detection member 4 comes down below the ice detection position 4B (the second position), the amount of ice accumulating under the ice tray 2 is small, so that the ice tray 2 is driven to discharge ice and the ice making action is performed. In contrast, if the ice detection member 4 does not come down below the ice detection position 4B (the second position), there exists the full ice state, where an adequate amount of ice has accumulated below, so that the discharge of ice is stopped and the ice making action is stopped as well. In the present embodiment, the regulation member 5 is supported on the frame 6, and the coming down of the ice detection member 4 is regulated by manually changing the position of the regulation member 5. Therefore, the ice making action and the like can be stopped even in a state other than the full ice state. Furthermore, since the regulation member 5 is a rotary member, the direction of movement of the regulation member 5 differs depending on the rotation position, and the direction of the force required for moving the regulation member 5 differs depending on the rotation position. In the present embodiment, for instance, the regulation member 5, which has been moved to the second rotation position 5B, does not rotate even if hit by the ice detection member 4 in the process of the ice detection action. It is therefore possible to avoid a situation where, due to the contact with the ice detection member 4, the regulation member 5 moves to a position not intended and is, as a result, not able to regulate actions of the ice detection member 4.

In the present embodiment, the ice detection member 4 is driven by the drive unit 3 from the standby position 4A (the first position) to a specified position. The specified position is the drive termination position, which is set between the standby position 4A and the interference position 4D. The ice detection member 4 moves by the ice detection member 4's own weight between the specified position (the drive termination position) and the ice detection position 4B (the second position). The ice detection member 4 is so constructed as to hit the regulation member 5 in the interference position 4D as set between the specified position (the drive termination position) and the ice detection position 4B (the second position). It is thus possible to avoid an overload state of the drive unit 3 when the ice detection member 4 collides with the regulation member 5.

In the present embodiment, the ice detection member 4 moves the regulation member 5 from the second rotation position 5B toward the first rotation position 5A when the ice detection member 4 hits the regulation member 5 during moving from the ice detection position 4B (the second position) toward the standby position 4A (the first position). In other words, the ice detection member 4 hits the regulation member 5 in the process of returning to the standby position 4A if a manipulation is performed to change the position of the regulation member 5 to the second rotation position 5B when the ice detection member 4 has come down to the ice detection position 4B or the lowest point position 4C. In the present embodiment, even in such case, the regulation member 5 is caused to retract by the ice detection member 4. Consequently, the ice detection member 4 is able to return to the standby position 4A even if a user moves the regulation member 5 according to an inappropriate timing.

In the present embodiment, when the ice detection member 4 hits the regulation member 5 during moving from the ice detection position 4B (the second position) toward the standby position 4A (the first position), the regulation member 5 is moved by the ice detection member 4 to the third rotation position 5C between the second rotation position 5B and the first rotation position 5A. In the third rotation position 5C, the center of gravity G of the regulation member 5 is located on the second rotation position 5B side with respect to the rotational axis L (the rotation center) of the regulation member 5, so that it is possible to make the regulation member 5 rotate by the regulation member 5's own weight from the third rotation position 5C to the first rotation position 5A. Consequently, the ice detection member 4 returns to a normal action.

The regulation member 5 of the present embodiment includes the shaft 52 rotatably supported on the frame 6, and the regulator 53 extending in a circular arc form around the shaft 52. The second arm 43 of the ice detection member 4 hits the regulator 53 and, as a result, the movement of the ice detection member 4 to the ice detection position 4B is regulated. By giving the regulator 53 a circular arc form, the strength of the regulator 53 is increased. In addition, the rotation of the regulation member 5 is made smooth by giving the regulator 53 a shape extending in the rotation direction of the regulation member 5.

The regulator 53 is not limited in form as long as the regulator 53 collides against the ice detection member 4 to regulate the movement of the ice detection member 4, that is to say, the regulator 53 may not be a wall in a circular arc form. The regulator 53 may be a pin protruding from the disk 51 in the direction Y2.

Modification

Figure 8:
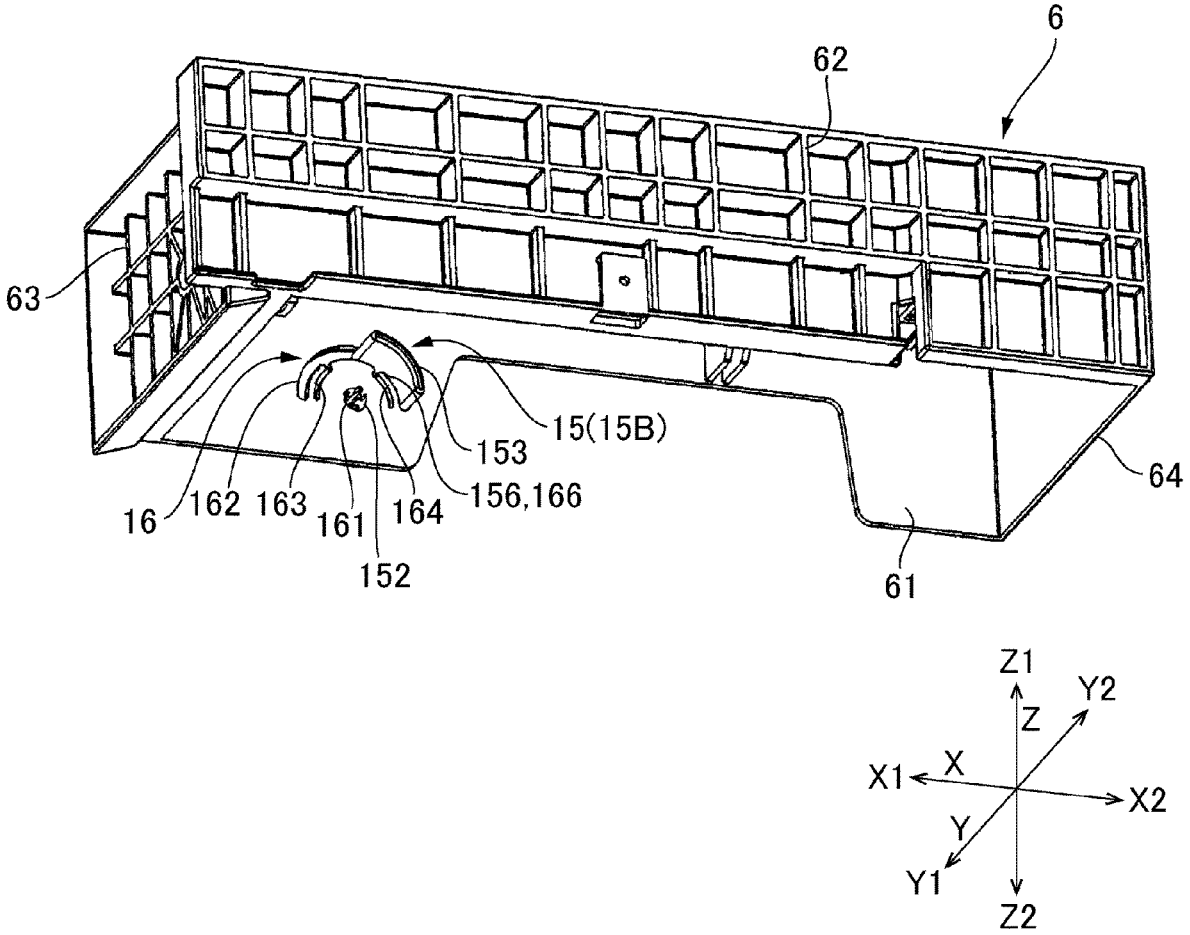
FIG. 8 is a perspective view of a regulation member and a frame of a modification.
Figure 9A:
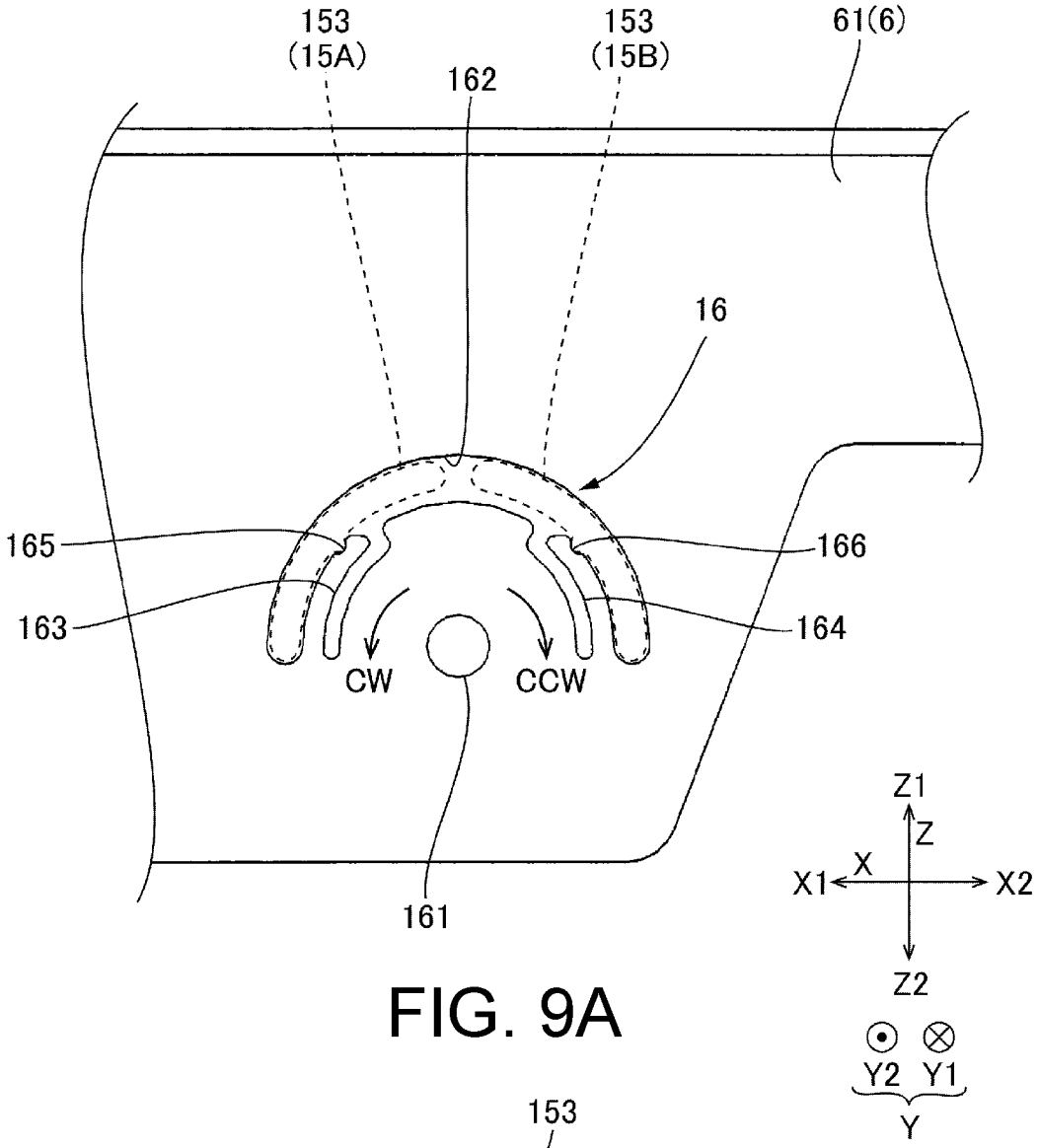
FIGS. 9A and 9B are front views of a regulation member fitting section and the regulation member of the modification.
Figure 9B:
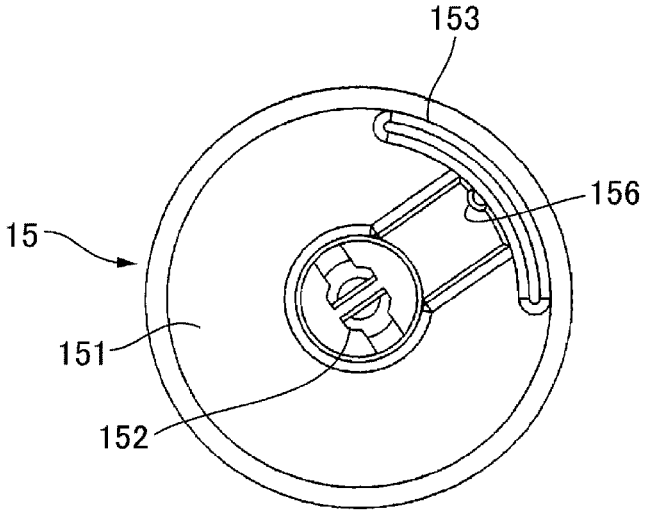

FIG. 8 is a perspective view of a regulation member 15 and a regulation member fitting section 16 of a modification. FIG. 9A is a front view of the regulation member fitting section 16 of the modification as viewed in the direction Y2, and FIG. 9B is a front view of the regulation member 15 of the modification as viewed in the direction Y2. The regulation member fitting section 16 of the modification includes a shaft hole 161 and a guide groove 162. The shaft hole 161 is identical in shape to the shaft hole 68 of the above embodiment. The guide groove 162 is identical in shape to the guide groove 69 of the above embodiment except that a first locking part 163 and a second locking part 164 are formed on an inner peripheral edge. The regulation member 15 of the modification includes a disk 151, a shaft 152, a regulator 153, and a handle (not illustrated). The disk 151, the shaft 152, and the handle are identical in shape to the disk 51, the shaft 52, and the handle 55 of the above embodiment, respectively. The regulator 153 is identical in shape to the regulator 53 of the above embodiment except that a projection 156 is formed on an inner peripheral face.

As illustrated in FIG. 9A, the first locking part 163 is a first arm that is elastically deformed inside in the radial direction and extends in a circular arc form from an end portion on the side CW in the circumferential direction of the guide groove 162 toward the side CCW in the circumferential direction. The second locking part 164 is a second arm that is elastically deformed inside in the radial direction and extends in a circular arc form from an end portion on the side CCW in the circumferential direction of the guide groove 162 toward the side CW in the circumferential direction. At the tip of the first locking part 163, a first holding groove 165 recessed inside in the radial direction is formed. At the tip of the second locking part 164, a second holding groove 166 recessed inside in the radial direction is formed.

The regulation member 15 of the modification moves to a first rotation position 15A, where the regulator 153 is located in the end portion on the side CW in the circumferential direction of the guide groove 162, and to a second rotation position 15B, where the regulator 153 is located in the end portion on the side CCW in the circumferential direction of the guide groove 162, as illustrated in FIG. 9A. In the regulation member 15 of the modification, a projection 156 provided on the regulator 153 is secured to the first holding groove 165 in the first rotation position 15A. In the second rotation position 15B, the projection 156 is secured to the second holding groove 166. The first locking part 163 (the first arm) and the second locking part 164 (the second arm) are elastically deformed inside in the radial direction when the projection 156 is disengaged from the first holding groove 165 and the second holding groove 166, respectively.

As described above, the regulation member 15 of the modification includes the projection 156, which is a locking counterpart that is secured to the first locking part 163 of the frame 6 in the first rotation position 15A, and to the second locking part 164 of the frame 6 in the second rotation position 15B. Consequently, the regulation member 15 is held in the first rotation position 15A and the second rotation position 15B, so that it is possible to suppress a situation where, due to the contact with the ice detection member 4, vibrations, and the like, the regulation member 15 moves to a position not intended. The regulation member 15 can easily be rotated by hand because the first locking part 163 (the first arm) and the second locking part 164 (the second arm) are elastically deformed to release the lock. Moreover, a click feeling is obtained when the projection 156 is fitted into the first holding groove 165 and when the projection 156 is fitted into the second holding groove 166, so that the operation of switching the regulation member 15 to the first rotation position 15A and the second rotation position 15B is easily and accurately carried out.

In the modified mode illustrated in FIGS. 8, 9A, and 9B, only one projection 156 is formed on the regulator 153, while two projections may be formed on the regulator 153, with one projection being to be secured to the first locking part 163 and the other to the second locking part 164.

In the modified mode illustrated in FIGS. 8, 9A, and 9B, the first locking part 163 (the first arm) and the second locking part 164 (the second arm) are elastically deformable in the radial direction, while a structure allowing the projection 156 to be elastically deformed in the radial direction may be provided on the regulation member 15. It is also possible to form a groove in the regulation member 15 that serves as a locking counterpart, and to form projections on the frame 6 that are fitted into the groove of the regulation member 15 and thus serve as a first locking part and a second locking part, respectively.

What is claimed is:

1. An ice making device comprising:

an ice tray;

a frame that supports the ice tray;

an ice detection member configured to detect an amount of ice accumulating under the ice tray;

a drive unit configured to drive the ice detection member downward from a first position and, when the ice detection member has come down below a second position, drive the ice tray to discharge ice; and a regulation member rotatably supported on the frame, wherein a rotation range of the regulation member includes:

a first rotation position to permit the ice detection member to come down below the second position; and a second rotation position to hit the ice detection member between the first position and the second position and regulate coming down of the ice detection member.

2. The ice making device according to claim 1, wherein the ice detection member is driven by the drive unit from the first position to a specified position and moves by the ice detection member's own weight between the specified position and the second position, and the ice detection member hits the regulation member between the specified position and the second position.

3. The ice making device according to claim 1, wherein the ice detection member moves the regulation member from the second rotation position toward the first rotation position when the ice detection member hits the regulation member during moving from the second position to the first position.

4. The ice making device according to claim 3, wherein the ice detection member moves the regulation member to a third rotation position between the second rotation position and the first rotation position when the ice detection member hits the regulation member during moving from the second position to the first position, and a center of gravity of the regulation member in the third rotation position is located on a side, where the second rotation position exists, with respect to a rotation center of the regulation member.

5. The ice making device according to claim 1, wherein the regulation member includes:

a shaft, rotatably supported on the frame; and a regulator, extending in a circular arc form around the shaft, wherein the ice detection member hits the regulator.

6. The ice making device according to claim 5, wherein the frame includes a first locking part that holds the regulation member in the first rotation position and a second locking part that holds the regulation member in the second rotation position, the regulation member includes a locking counterpart that is secured to at least one of the first locking part and the second locking part, and the first locking part and the second locking part are elastically deformed or the locking counterpart is elastically deformed.

7. The ice making device according to claim 6, wherein the first locking part is a first holding groove provided on a first arm that is elastically deformed in a radial direction, the second locking part is a second holding groove provided on a second arm that is elastically deformed in the radial direction, the locking counterpart is a projection that protrudes from the regulator in the radial direction, the regulation member is held in the first rotation position with the projection fitted in the first holding groove, and the regulation member is held in the second rotation position with the projection fitted in the second holding groove.

* * * * *